United States Patent [19]

Schlegel

[11] 4,018,242

[45] Apr. 19, 1977

[54] FIRE HOSE CABINET

[76] Inventor: Herold M. Schlegel, 2812 Fernwood, Ann Arbor, Mich. 48104

[22] Filed: Dec. 1, 1975

[21] Appl. No.: 636,712

[52] U.S. Cl. ..... 137/355.18; 169/51; 220/18

[51] Int. Cl.[2] ..... A62C 35/20

[58] Field of Search ..... 169/51, 48; 137/355.16, 137/355.18; 220/18; 239/195, 196

[56] References Cited

UNITED STATES PATENTS

| | | | |
|---|---|---|---|
| 1,360,436 | 11/1920 | Owen | 137/355.18 X |
| 2,993,503 | 7/1961 | Pokryfke et al. | 137/355.18 |

*Primary Examiner*—John J. Love
*Assistant Examiner*—Michael Mar
*Attorney, Agent, or Firm*—D. Paul Weaver

[57] ABSTRACT

A household fire hose cabinet employs a folded fire hose storage compartment bounded on one side by a stationary vertical partition and on the opposite side by a spring-urged hinged partition. The folded fire hose is retained in the storage compartment by a flexible strap harness having releasable snap fasteners. Releasing of the strap harness by pulling a terminal end thereof will forcefully remove the hose from the storage compartment and allow the spring-urged partition to swing to an open position in relation to a fire valve and operating handle which are normally enclosed between the hinged partition and the adjacent end wall of the cabinet. A storage compartment for a portable fire extinguisher is provided between the fixed partition and the other vertical wall of the cabinet. The forward open side of the cabinet is normally covered by a downwardly swinging hinged front closure which may be formed by a simulated painting.

8 Claims, 8 Drawing Figures

FIG. 1
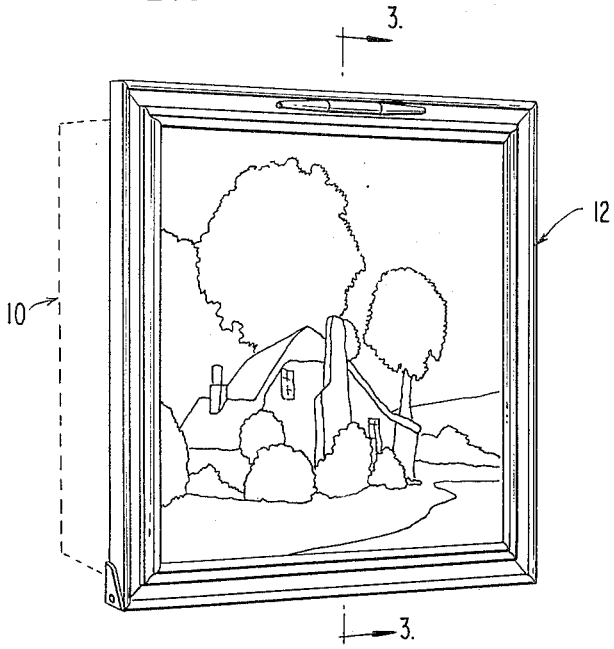
FIG. 2
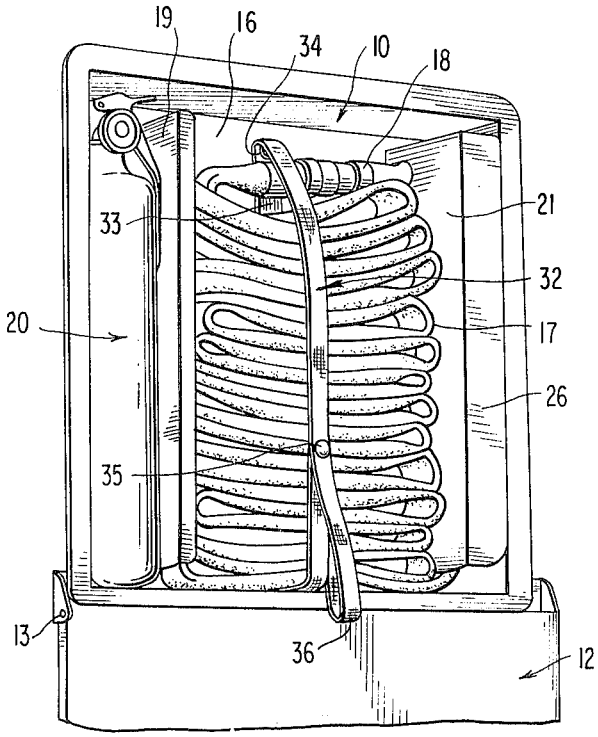
FIG. 3
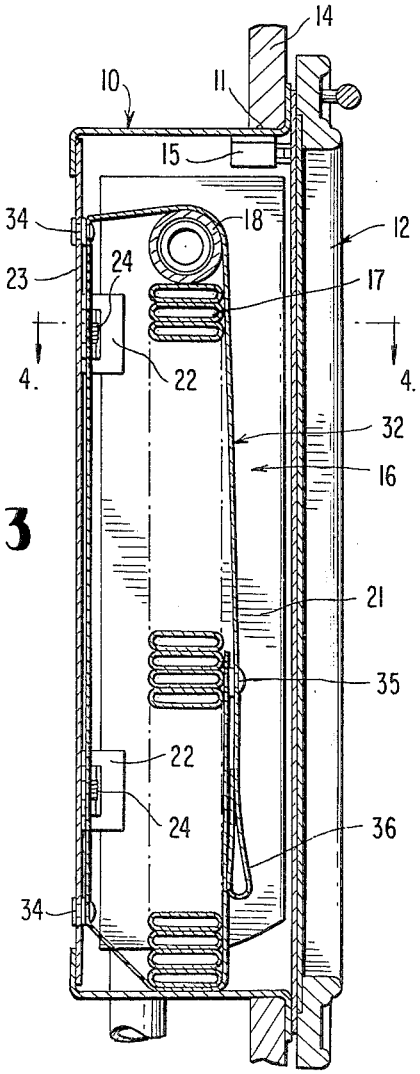
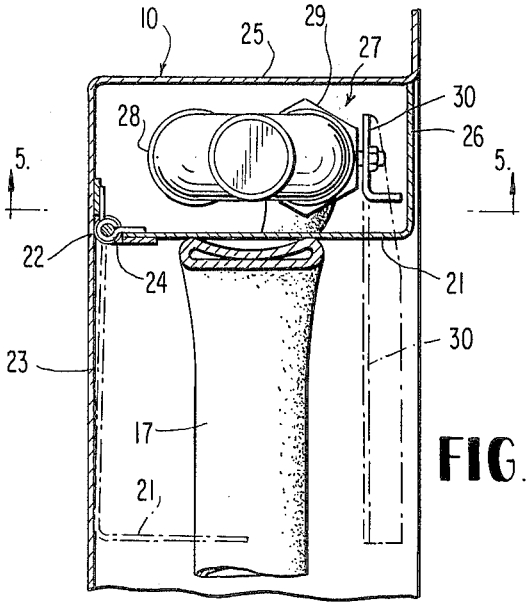
FIG. 4

FIG. 6
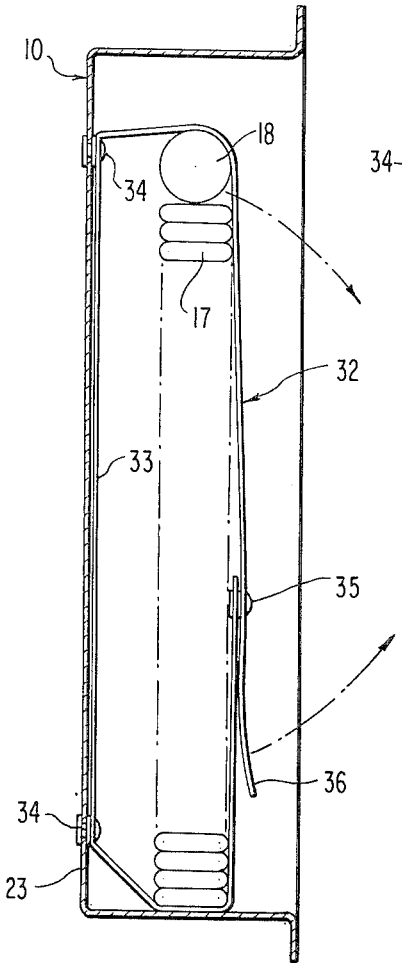
FIG. 7
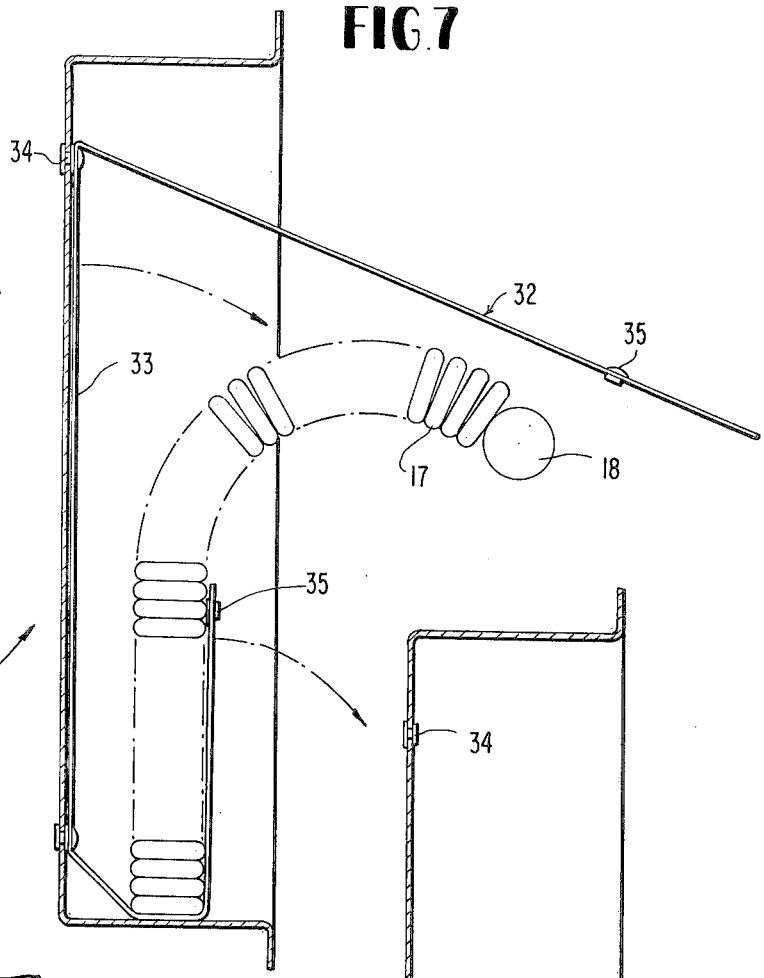
FIG. 5
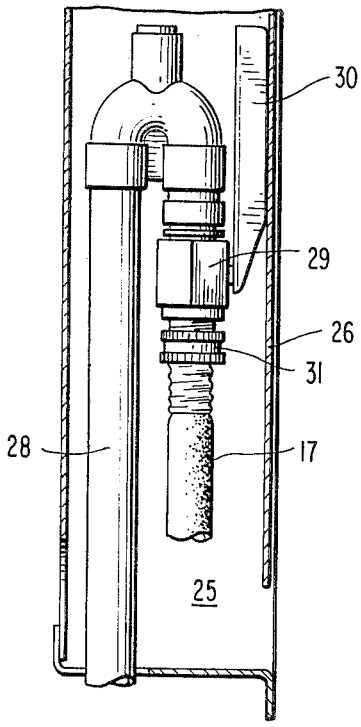
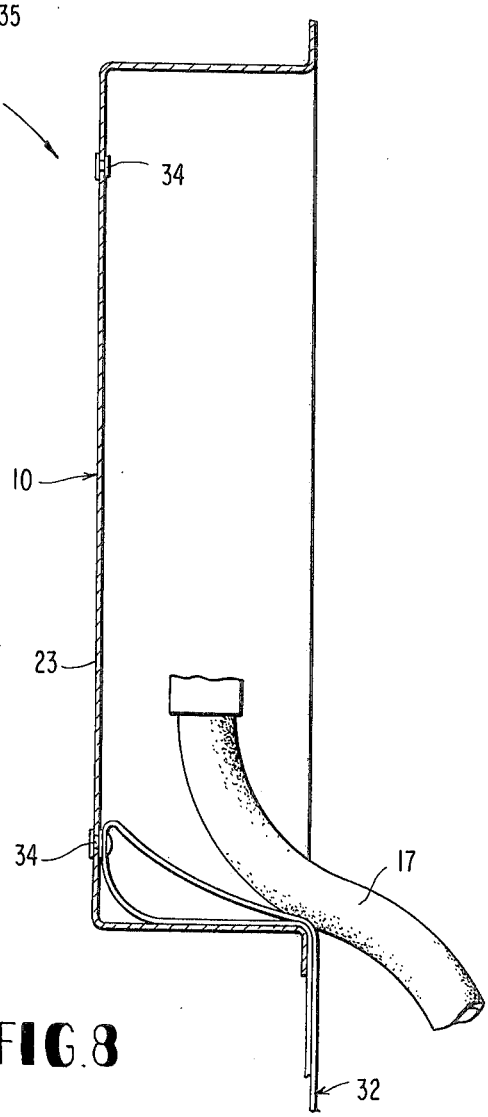
FIG. 8

FIRE HOSE CABINET

BACKGROUND OF THE INVENTION

A need exists for a practical, safe and economical home fire-fighting station which will not be unsightly or otherwise objectionable to the home owner. For such a device to be practical, particularly in the presence of children, it is necessary that the water valve be concealed and inaccessible except when proper procedures are followed for using the device in a fire emergency.

The objectives of the invention are to satisfy these needs while providing a household fire fighting station which can be mounted in a wall recess so as to simulate a painting on the wall of a home and to provide in the fire-fighting station a unique means to store the fire hose compactly in a non-use position, while the stored hose maintains a spring-loaded fire valve closure panel in a closed valve-concealing position within the cabinet.

Summary of the Invention

In accordance with the present invention, a folded fire hose is held releasably in a storage compartment of a wall mounted cabinet in folded vertically stacked layers by a flexible strap harness having snap fastener means. In such stored condition, the fire hose bears on the outer face of a hinged spring-urged valve and stand pipe guard or partition within the cabinet and prevents the latter from uncovering and exposing the fire valve and its operating handle. When the strap harness is pulled and released in a fire emergency, the hose is cleanly ejected from the cabinet and the valve guard is released to swing open under influence of the spring so that the valve and its handle are exposed for use.

Other features and advantages of the invention will become apparent during the course of the following description.

BRIEF DESCRIPTION OF DRAWING FIGURES

FIG. 1 is a perspective view of a fire hose cabinet embodying the invention.

FIG. 2 is a perspective view of the cabinet with the front closure panel in an open position.

FIG. 3 is an enlarged vertical section taken on line 3—3 of FIG. 1.

FIG. 4 is a horizontal section taken on line 4—4 of FIG. 3.

FIG. 5 is a fragmentary vertical section taken on line 5—5 of FIG. 4.

FIGS. 6, 7 and 8 are partly diagrammatic side elevational views showing the operation of a strap harness for releasing and ejecting the fire hose from the cabinet.

DETAILED DESCRIPTION

Referring to the drawings in detail wherein like numerals designate like parts, the numeral 10 designates a sturdy, preferably sheet metal box or cabinet of rectangular formation adapted to be supported in a wall opening 11 in a home or the like. The forward vertical side of the housing 10 is open to allow ready access to the interior of the cabinet in a fire emergency. This forward open side is normally covered and concealed by a vertically swingable front closure panel 12, hinged as at 13 to the bottom of the cabinet 10 so that the closure panel may swing downwardly below the cabinet to a vertical position substantially against the wall 14 on which the cabinet 10 is flush mounted, FIG. 3. The closure panel 12 may be secured in the upstanding closed position by a magnetic catch 15, or any other suitable catch means. As shown in FIG. 1, the closure panel 12 may simulate a framed painting and thus totally conceal the fire hose cabinet behind it except when the device is in use.

The cabinet has a central fire hose storage compartment 16 within which a fire hose 17 of suitable length may be folded back and forth with its folded layers vertically stacked and with the hose nozzle 18 arranged uppermost in the compartment 16.

A stationary vertical cabinet partition 19 near one side wall of the cabinet forms an abutment for the folded hose 17 tending to stabilize the hose and maintain it stacked in the compartment 16. A portable fire extinguisher 20 may be stored in the space between the partition 19 and the adjacent vertical side of the cabinet 10.

Near the opposite vertical side of the cabinet 10, an L-shaped guard or partition 21 is mounted on a vertical axis hinge 22 at the rear wall 23 of the cabinet for horizontal swinging movement on such hinge between the two positions shown in full and phantom lines in FIG. 4. The guard 21 is urged toward the phantom line position by a torsion spring 24 associated with the hinge. When in the open position shown in phantom lines in FIG. 4, the guard engages the back wall 23 and has moved away from the adjacent vertical side wall 25 of the cabinet. When the guard 21 is in the full line position, its forward right angular flange 26 contacts the cabinet side wall 25 and forms with this side wall a compartment 27 for enclosing and concealing the adjacent portion of a vertical stand pipe 28 and the associated fire valve or petcock 29 having an operating handle 30, as shown in FIGS. 4 and 5. As best shown in FIG. 5, the fire hose 17 is coupled to the valve 29 by a coupling 31. When the handle or lever 30 is in the vertical position shown in FIG. 5, the valve 29 is closed and water cannot enter the hose 17. When the lever is swung to the horizontal position shown in phantom lines in FIG. 4, the valve 29 is opened and water is admitted to the fire hose.

An important feature of the invention resides in utilizing the stacked fire hose 17 in storage compartment 16 to engage the spring-urged guard or partition 21 and hold the same in the closed position, as shown in FIG. 2, for enclosing and concealing the valve 29 and the handle or lever 30 with the latter in the upright valve closing position. Thus, it is impossible for a child to tamper with the lever 30 while the fire hose is in the stored position and the child will not be attracted to the lever which is concealed by the guard 21.

In order to maintain the hose in the storage compartment 16, a flexible strap harness 32 is looped about the stacked hose with the rear side 33 of the strap harness releasably anchored by snap fasteners 34 to the cabinet rear wall 23. At the forward side of the stacked hose, the ends of the strap harness are joined by another snap fastener 35 and a pulling loop 36 extends below this point of connection so the user of the device may grasp the loop 36 and pull it to eject the fire hose.

FIGS. 6 through 8 show the ejection sequence for the hose. In FIG. 6, the extension or loop 36 is pulled upwardly to separate the snap fastener 35 and release the hose for ejection. Additional tension on the strap harness will separate the upper snap fastener 34 so that the rear portion 33 of the strap harness will forcefully push or eject the fire hose forwardly from the cabinet 10.

When the hose is thus ejected from the cabinet, the guard 21 will be moved by the springs 24 to the open position shown in phantom lines in FIG. 4, and the valve operating lever 30 is exposed and may be grasped and pulled downwardly to the horizontal "on" position. The interior of the guard 21 may be visibly marked to show the "on" and "off" positions for the handle or lever 30 to further aid the user in an emergency.

After usage and with the fire hose drained of water and restacked in the storage compartment 16 and with the lever 30 in the upright "off" position, the fire hose will again bear against the guard or partition 21 and hold the same in a closed position with the flange 26 abutting cabinet side wall 25.

It is to be understood that the form of the invention herewith shown and described is to be taken as a preferred example of the same and that various changes in the shape, size and arrangement of parts may be resorted to, without departing from the spirit of the invention or scope of the subjoined claims.

I claim:

1. A household fire-fighting station comprising a cabinet body adapted for mounting in a wall opening and having a forward open vertical side and vertical side walls, a movable closure panel for said open side, a stand pipe and valve positioned in the cabinet body near one vertical side wall thereof, a hinged substantially L-shaped guard within the cabinet body adapted in a first position to cover and enclose the stand pipe and valve and in a second position to expose the stand pipe and valve, spring means connected with said guard biasing it to said second position, said cabinet body having a fire hose storage compartment, a fire hose coupled with said valve and adapted to be folded in vertically stacked layers within said storage compartment, and manually releasable retainer means holding said fire hose in said compartment with the fire hose engaging said guard and holding it in said first position against the force of said spring means.

2. A household fire-fighting station as defined in claim 1, and said manually releasable retainer means comprising a flexible strap element looped around said hose in said storage compartment and having a separable connector at the forward side of the stored hose releasable by tension on one end of said strap element.

3. The structure of claim 2, and a second releasable connector attaching the strap element to said cabinet body, whereby tension on the strap element will cause ejection of the fire hose from said storage compartment and the release of said guard.

4. A household fire-fighting station as defined in claim 1, and said fire hose storage compartment formed by a back wall of the cabinet body, said guard when the guard is in said first position, and a stationary vertical partition in said cabinet body in spaced opposed relation to said guard.

5. A household fire-fighting station as defined in claim 1, and said movable closure panel hinged to the bottom of the cabinet body at its forward side and the forward face of the closure panel simulating a framed painting and fully concealing said cabinet body when in an upright closed position.

6. The structure of claim 4, and a portable fire extinguisher in said cabinet body between said stationary vertical partition and the adjacent vertical side wall of the cabinet body.

7. A household fire-fighting station as defined in claim 1, and said L-shaped guard extending vertically within said cabinet body and being horizontally swingable on a vertical axis hinge means and terminating above the bottom of the cabinet body whereby the hose coupled with said valve may extend under the lower edge of said guard.

8. A household fire-fighting station as defined in claim 7, and said spring means consisting of a torsion coil spring connected with said vertical axis hinge means, said guard having a forward right angular flange abutting the adjacent vertical side wall of the cabinet body when said guard is in said first position.

* * * * *